United States Patent [19]

Salomon

[11] 4,095,821

[45] Jun. 20, 1978

[54] SAFETY SKI BINDING

[75] Inventor: Georges Pierre Joseph Salomon, Annecy, France

[73] Assignee: Etablissements Francois Salomon et Fils, Annecy, France

[21] Appl. No.: 697,537

[22] Filed: Jun. 18, 1976

[30] Foreign Application Priority Data

Jun. 20, 1975 France ..... 75 19439

[51] Int. Cl.[2] ..... A63C 9/08

[52] U.S. Cl. ..... 280/628; 280/630

[58] Field of Search ..... 280/625, 626, 628, 630

[56] References Cited

U.S. PATENT DOCUMENTS

| | | | |
|---|---|---|---|
| 3,632,123 | 1/1972 | Salomon | 280/628 |
| 3,909,030 | 9/1975 | Beyl | 280/630 |

FOREIGN PATENT DOCUMENTS

| | | | |
|---|---|---|---|
| 2,049,433 | 3/1971 | France | 280/628 |

*Primary Examiner*—Robert R. Song

*Attorney, Agent, or Firm*—Pollock, Vande Sande & Priddy

[57] ABSTRACT

The safety binding comprises a vertical pivot integral with a base mounted to the ski, a binding rotating upon the pivot and carrying means for retaining the boot, a locking system ensuring that the boot is maintained in a specific position upon the ski, and a compensating mechanism acting upon the locking system to cause a lateral retention force applied to the boot to vary inversely to a vertical retention force. The compensating mechanism includes a first part mounted to pivot about an axis at right angles to the longitudinal axis of the ski, and a second part mounted in the binding and movable relative to the first part; this second part cooperate, through a system of ramps, with the boot-retaining means to oppose the lifting of the boot.

16 Claims, 17 Drawing Figures

SAFETY SKI BINDING

The present invention relates to a safety binding for skis, the binding being laterally, and possibly vertically, releasable in relation to the ski, against the action of a resilient locking system.

This type of binding is intended to assure essentially the skier's safety by responding to torsion loads on the leg bone (lateral release).

With this type of binding, a problem arises when the boot-retaining elements or means, opposing vertical lifting of the boot, are stressed vertically, for example by reason of the presence of a thickness of snow under the sole, since this vertical stressing of the binding components opposes lateral displacement, in that the elements opposing the lifting of the boot press the boot harder against the ski. This phenomenon may prevent the binding from operating normally in lateral release, which is dangerous if the skier's leg is subjected to abnormal torsion.

A certain number of bindings seeking to solve this problem are known. These are known as "compensating" bindings, of which there are several types in existence; more particularly one is described in French Pat. No. 2,049,433 and comprises:

- a vertical pivot integral with a base secured to the ski;
- a binding element rotating upon the pivot and carrying means for retaining the boot;
- a system for locking the retaining means, the system being mounted in the binding element and ensuring that the boot is maintained in a specific position upon the ski, the locking system comprising at least one resilient element and opposing a vertical retaining force and a lateral retaining force, respectively, to the vertical lift and lateral displacement of the boot, the resilient element being furthermore preset to allow the boot to be released when subjected to predetermined stresses in the plane of the ski;
- and a compensating mechanism acting upon the locking system, in order to cause the lateral retaining force applied to the boot to vary inversely to the vertical retaining force.

The present invention proposes improvements in the above-mentioned type of binding and, to this end, is characterized in that the compensating mechanism comprises:

- a first part which pivots about an axis at right angles to the longitudinal axis of the ski and is located in the kinematic chain consisting of the resilient element and a reaction part which is stationary in relation to the ski;
- and a second part located in the binding element, which is mobile in relation to the first part, and which cooperates through a system of ramps with the boot-retaining means opposing the lifting of the boot.

The transverse axis carrying the first part is preferably located in the binding, while the second part is arranged to pivot in relation to the first part.

Furthermore, in a particularly advantageous manner, the boot-retaining means consist of:

- on the one hand, a jaw integral with the front of the binding and enclosing the sole of the boot laterally;
- and, on the other hand, a sole-clamp opposing the lifting of the boot, the sole-clamp being independent of the jaw, and being mounted so that it pivots about a horizontal axis in the binding.

According to one embodiment of the invention, the stationary reaction part pertains to the stationary vertical pivot, and preferably consists of a vertical flat on the pivot, or a curved profile in relief or in countersink.

Various forms of compensating system may be used. Thus, according to one aspect of the invention, the compensating mechanism consists of rocker arms, one of which is hinged about a horizontal axis in the binding, while the other is mounted to rock on the first rocker arm, the first of these rocker arms bearing against the pivot, while the second bears against a cross member mounted in the sole-clamp and transfers, to the second rocker arm, the loads due to displacement of the sole-clamp. The rocker arms are arranged in such a manner that one may move in relation to the other.

If the resilient system consists of a single spring bearing, on the one hand, against the binding and, on the other hand, against the second rocker arm, the transfer of the thrust from the spring to the first rocker arm is produced by a contact area between the rocker arms, the distance from the pivot axis of the first rocker arm varying as a function of the relative angular position in relation to the rocker arms.

According to another embodiment of the invention, which also uses two rocker arms as the compensating mechanism, the rocker arms pivot about a horizontal axis in the binding (preferably a common axis), the first rocker arm being caused to bear against the pivot by a first spring constituting the resilient locking system, while the second rocker arm is associated with a second spring in the resilient locking system, the free end of this second rocker arm being designed to cooperate with the rear part, in the form of a cam, of the sole-clamp. The first rocker arm also has a bearing surface acting as a stop for the second rocker arm, so that when one of the rocker arms is bearing against the other, the load produced by the spring associated with the second rocker is transferred entirely to the first.

According to another embodiment, the compensating mechanism consists of:

- a single rocker arm pivoting about a horizontal axis in the binding and urged towards the pivot by a spring, one end of which bears against the binding and the other against the rocker arm;
- a part mounted in the sole-clamp housing so that it can move in relation thereto, the part being in constant contact, on the one hand with a ramp on the free end of the rocker arm and, on the other hand, with the pivot, and being designed to transfer the stresses between the sole-clamp, the rocker arm, and the pivot.

It is to be understood that the invention may be applied to stops or heel-pieces.

A description will be given hereinafter, by way of non-restrictive examples, of a plurality of forms of execution of the invention, as applied to stops, with reference to the drawings attached hereto, wherein.

Figure 5:
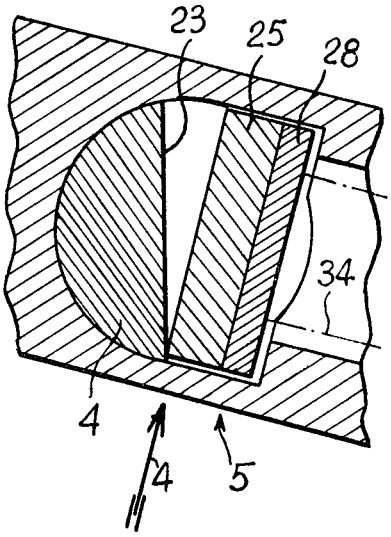
FIG. 5 is a section along line 5—5 in FIG. 4.
Figure 4:
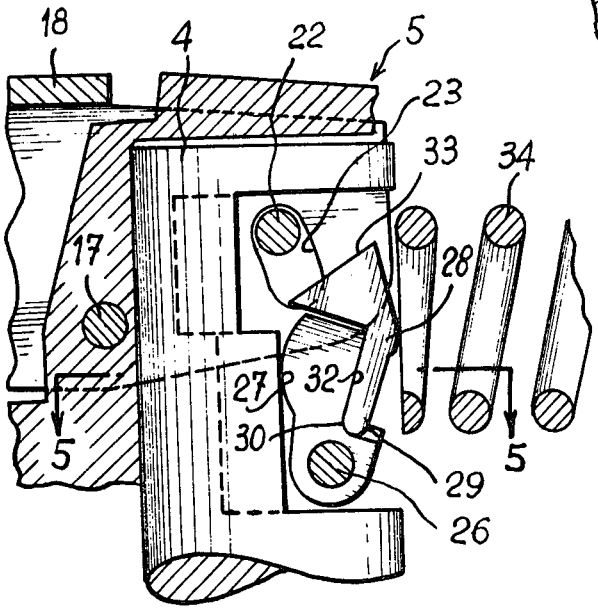
FIG. 4 is a detail illustrating the position of the compensating mechanism at the time of a lateral release.
Figure 5A:
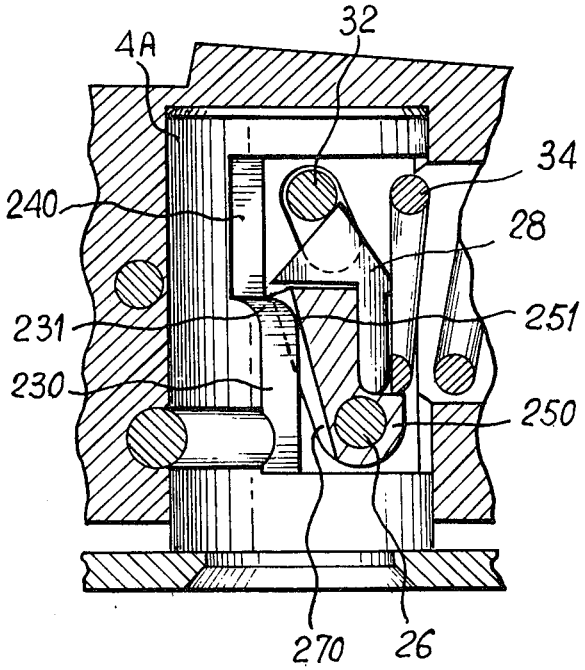
Figure 5B:
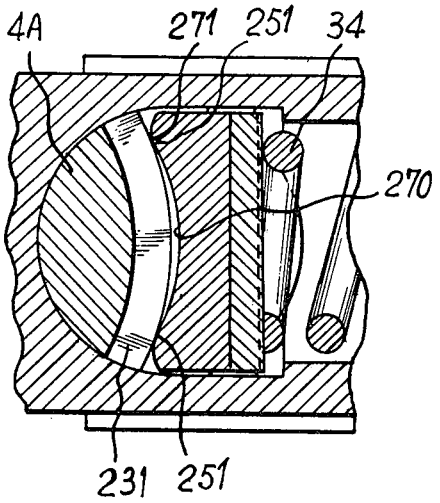
Figure 5C:
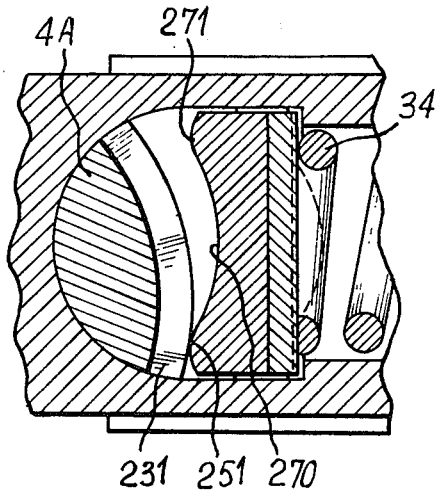
Figure 7:
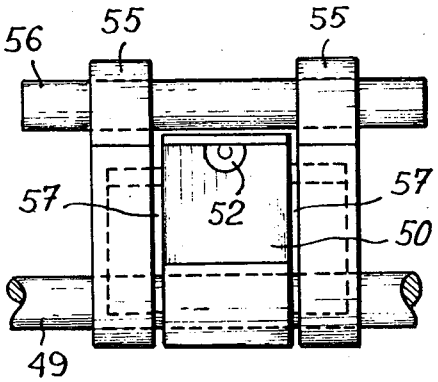
Figure 6:
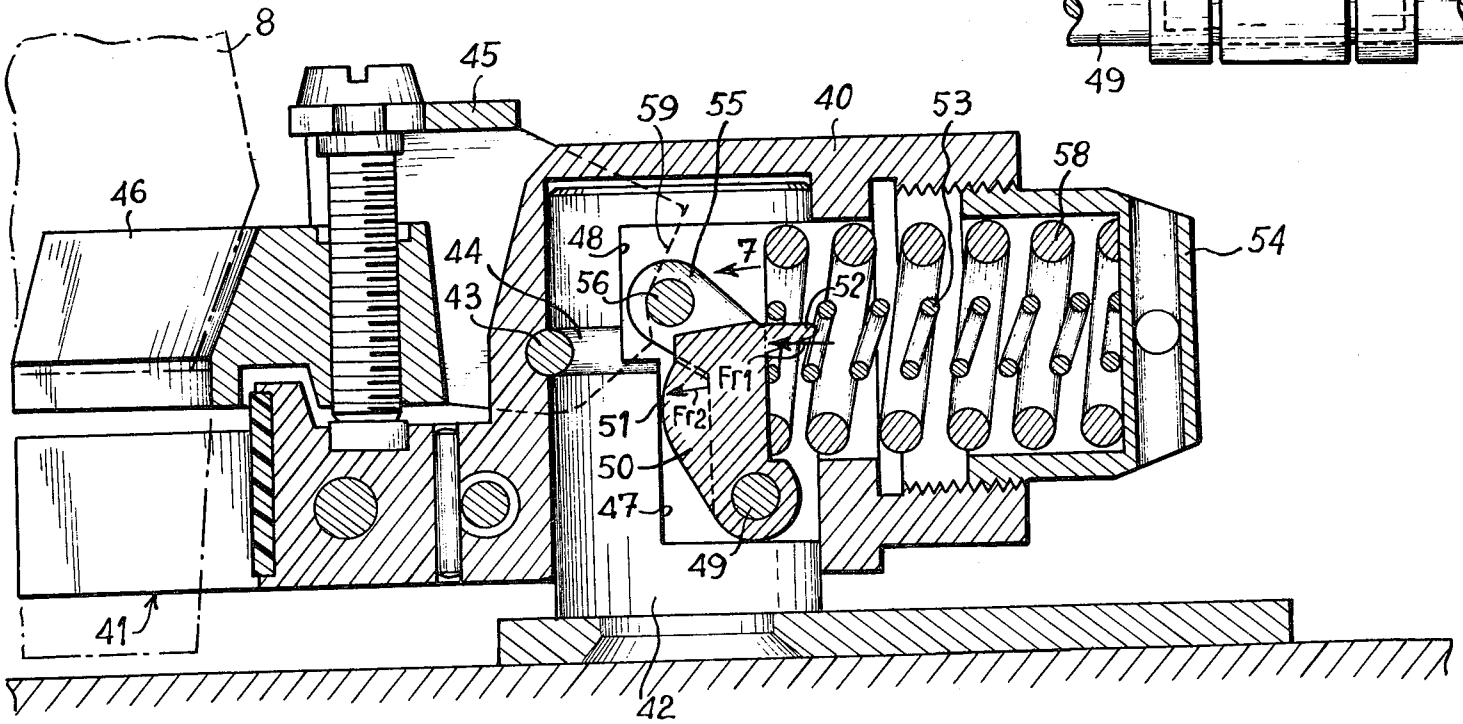
Figure 8:
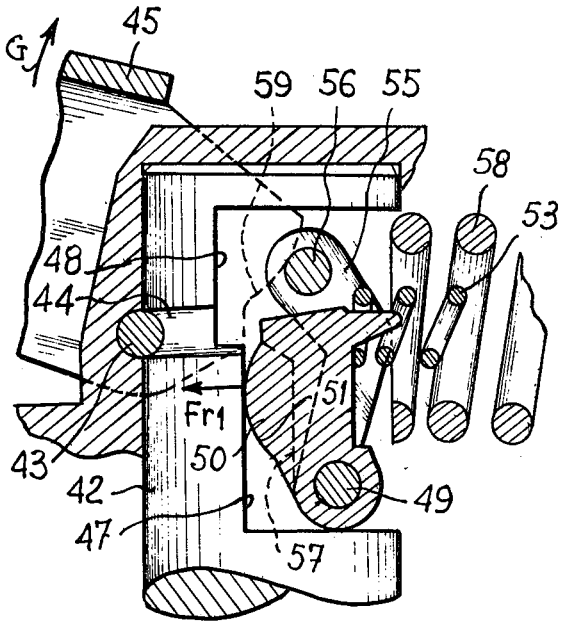
Figure 10:
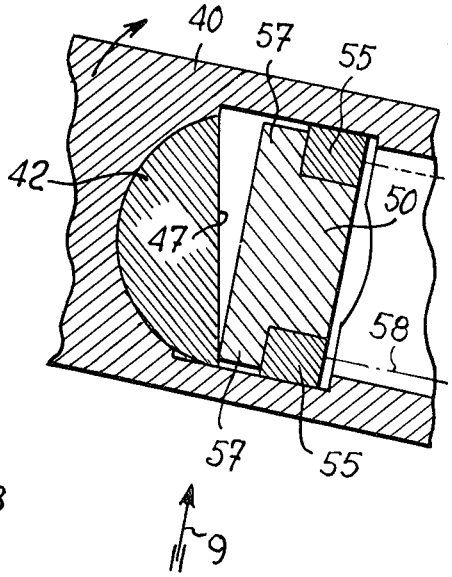
Figure 9:
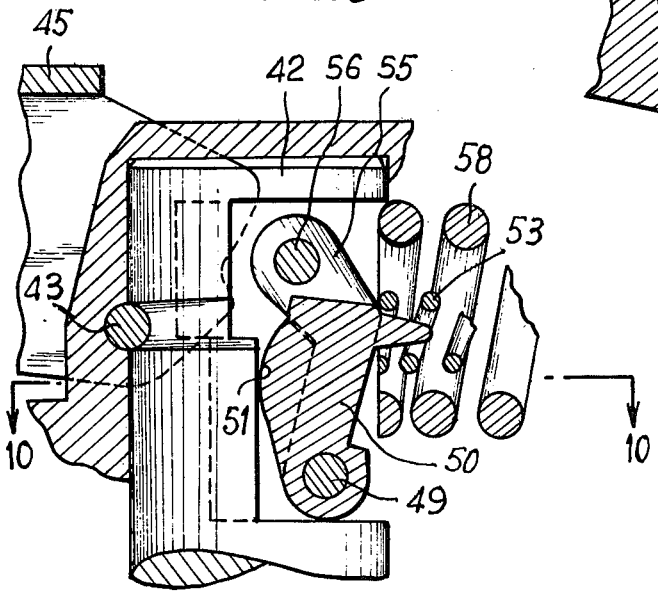
Figure 11:
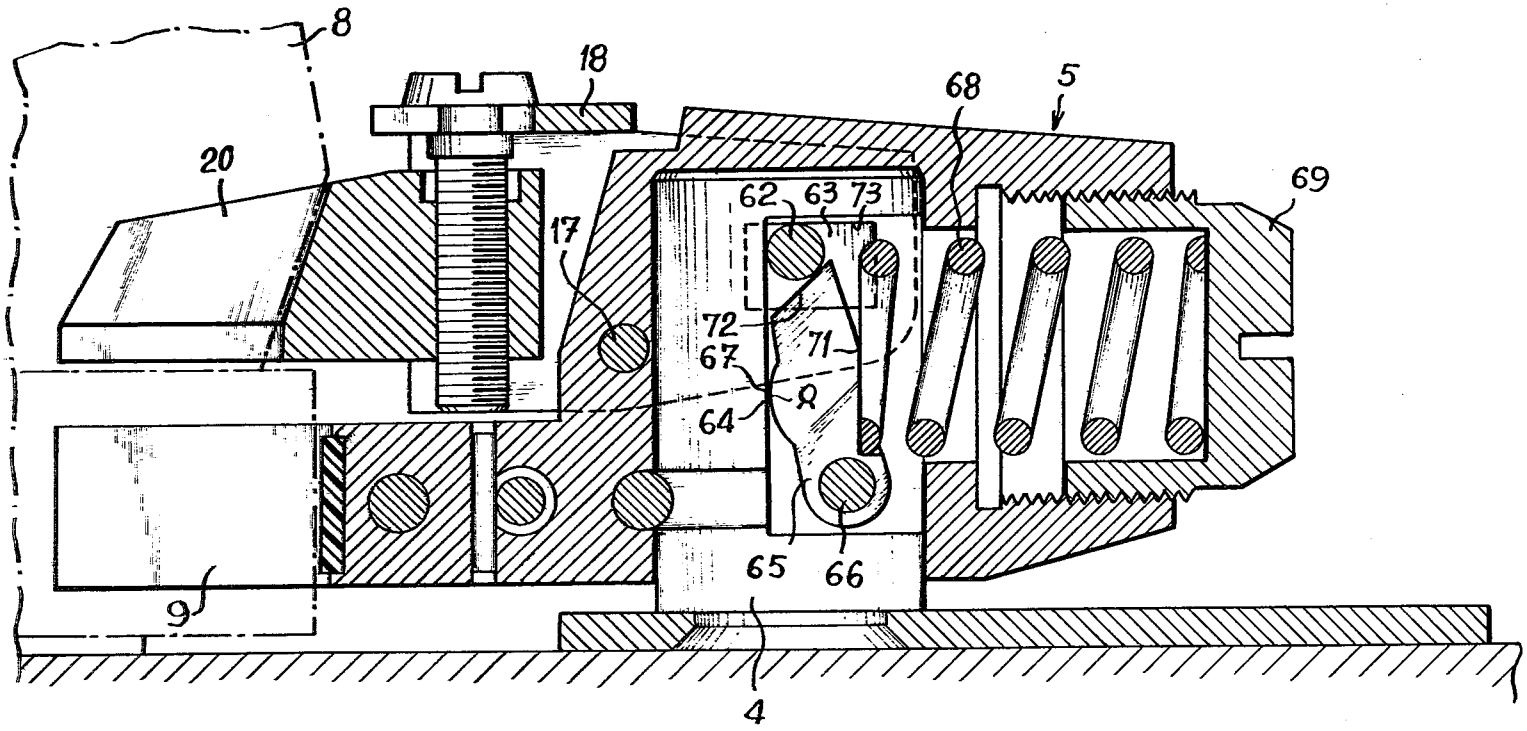
Figure 12:
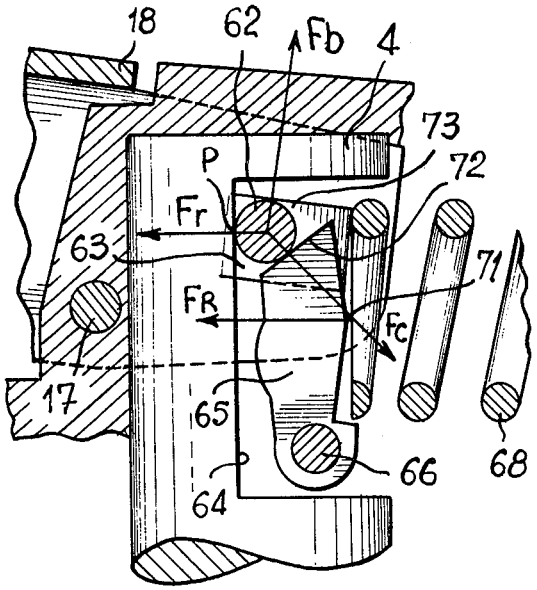
Figure 14:
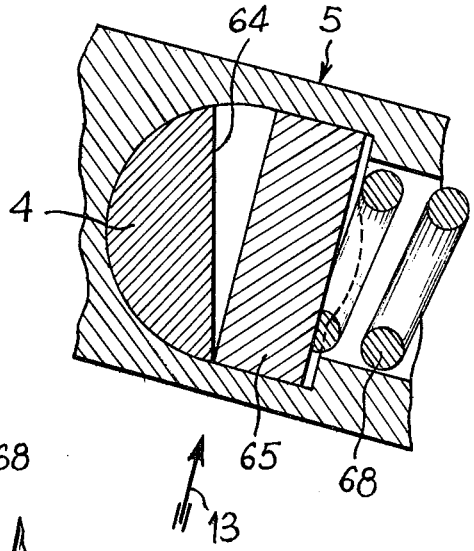
Figure 13:
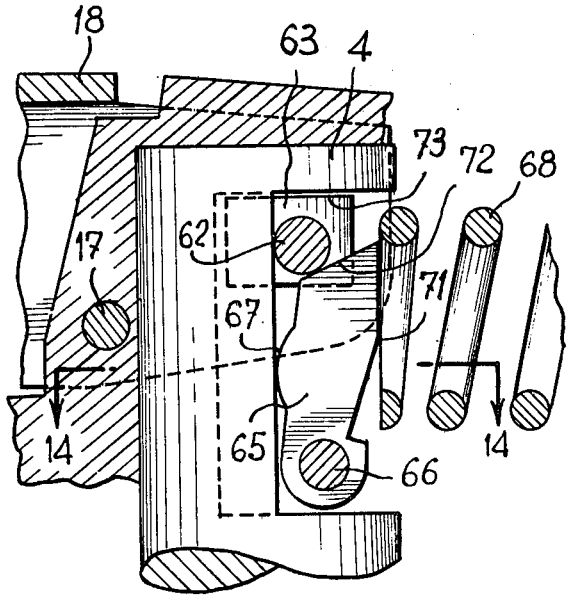

FIGS. 5*a*, 5*b*, 5*c* illustrate details of a variant of the binding according to FIGS. 1–5;

FIG. 6 illustrates, in longitudinal section, a second embodiment of the binding according to the invention;

FIG. 7 is a detail, seen in the direction of arrow 7 in FIG. 6, showing the compensating mechanism;

FIGS. 8 and 9 illustrate the position of the compensating mechanism, in the case of the sole-clamp being lifted, and in the case of a lateral release, respectively;

FIG. 10 is a view along line 10—10 in FIG. 9;

FIG. 11 illustrates, in longitudinal section, a third embodiment of the binding according to the invention;

FIGS. 12 and 13 illustrate the compensating mechanism, in the condition corresponding to the lifting of the sole-clamp, and in that corresponding to a lateral release, respectively;

FIG. 14 is a section along line 14—14 in FIG. 13.

Figure 1:
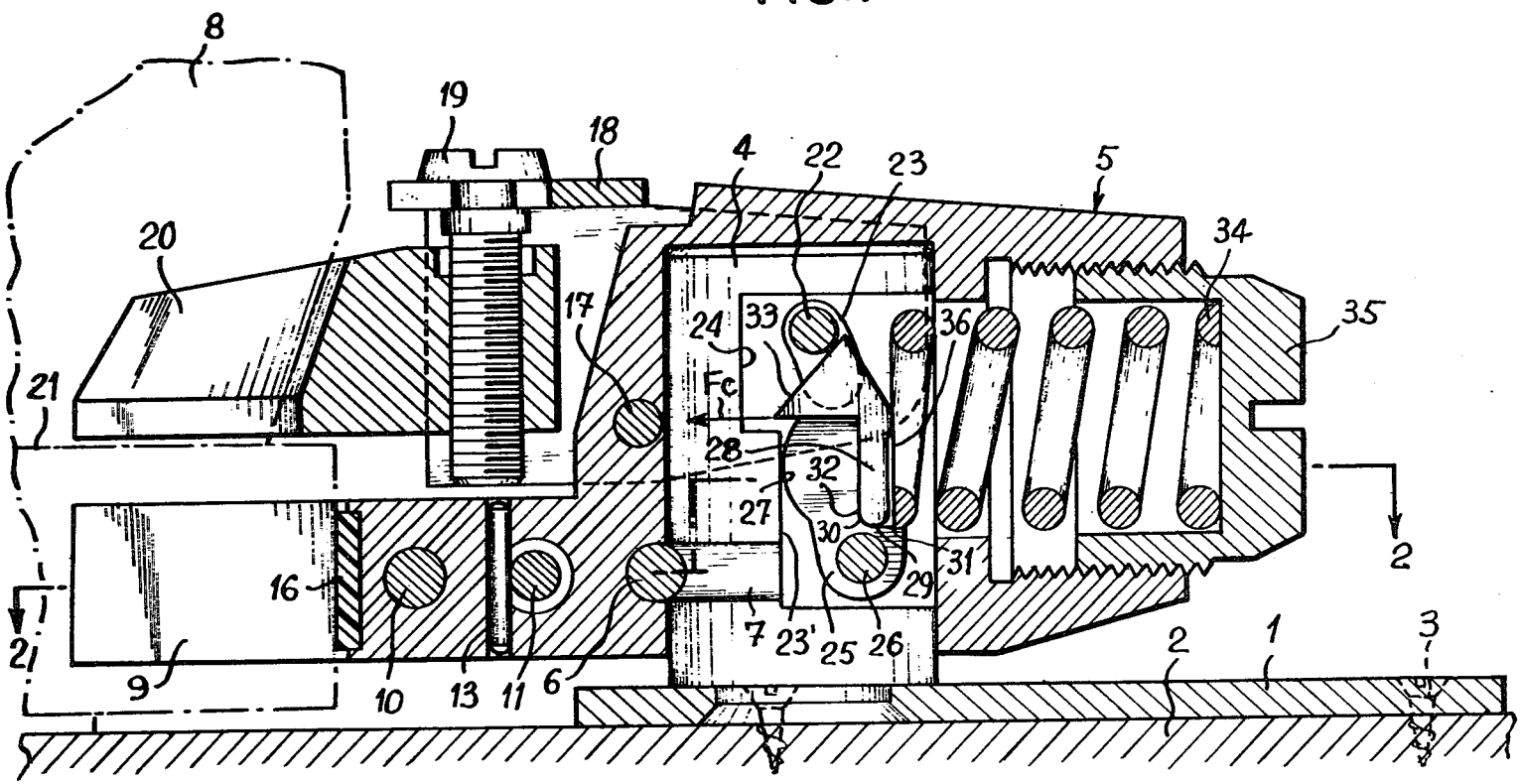
FIG. 1 illustrates, in longitudinal section, a binding according to a first embodiment of the invention.

In FIG. 1, element 1 is a base for a binding secured to a ski 2, for example by means of screws 3. Base 1 is integral with a vertical pivot 4, generally cylindrical in appearance, upon which is mounted, rotatably, a binding generally denoted as 5. A horizontal rod 6, passing through the binding, engages in a groove 7 in pivot 4, in order to prevent any displacement in translation of binding 5 along the pivot, while still permitting rotation.

Figure 2:
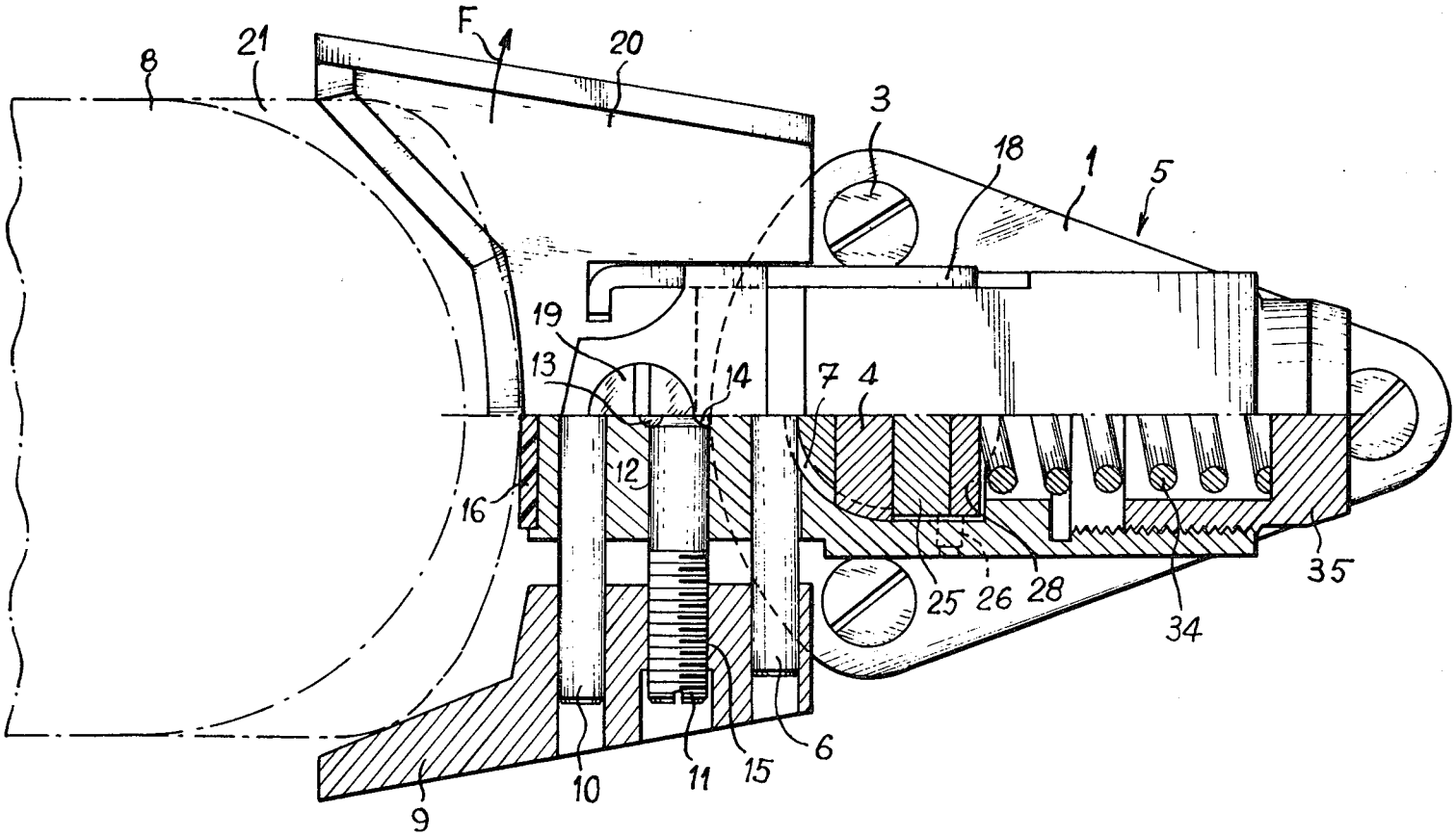
FIG. 2 is a plan view of the binding according to FIG. 1, taken along line 2—2 in FIG. 1.

As may be seen more particularly in FIG. 2, the binding is also equipped with a jaw designed to engage laterally the sole of the boot shown at 8. This jaw consists of two lateral arms 9 mounted upon guide rods 6, 10 integral with the binding. The gap between the arms is adjustable by means of an adjusting screw 11, the central cylindrical part 12 of which is accommodated rotatably in a bore in the binding, and is secured in translation by means of a vertical split-pin 13 engaging in a groove 14 in the screw. The ends of screw 11 have left and right-hand threads 15 engaging in the threaded holes in each arm. Screw 11 is operated, for example, by inserting a screwdriver into slots in the ends of the screw. It is desirable for the part of the binding in contact with the boot, and possibly the arms of the jaw, to be lined with a friction plate 16.

Hinged to a horizontal axis 17 accommodated in the binding is a generally U-shaped rocker 18, the lateral arms of which, located externally of the binding, are connected together by an upper cross member carrying a screw 19 which is fixed in translation, the threaded part thereof carrying a sole-clamp 20, the lower surface of which faces the upper edge 21 of the sole of the boot. The screw 19 makes it possible to adjust the sole-clamp vertically, in order to adjust it to the various types of boot used.

It will be observed that normally, when the binding is closed, in the position in which it holds the boot (see FIG. 1), a small amount of play exists between the sole-clamp and the sole of the boot, so that in the event of a purely lateral release, there is no parasitic friction between the sole-clamp and the boot.

At its end remote from the sole-clamp, rocker 18 comprises a cylindrical cross member 22 secured to the lateral arms of the rocker and passing through the binding. To this end, the binding is equipped with ports 23 in the form of arcs of a circle centred upon axis 17 of the rocker.

Pivot 4 is recessed over a portion of its height and presents a flat 23′ and an upper recess 24 approximately on a level with cross member 22. Accommodated in the recess in the pivot is a first rocker 25 hinged at its lower end on a horizontal axis 26 integral with the binding. This rocker 25 has a surface opposite flat 23′, in the form of a portion of a cylinder 27 with a horizontal axis, the cylindrical portion being designed to cooperate with flat 23′.

On the side remote from this cylindrical portion, rocker 25 is equipped with a seat for a second rocker 28, the lower edge 29 of which is semi-cylindrical. This edge 29 of the second rocker is accommodated in a fillet 30 in the seat of the first rocker. This fillet 30 has the same radius as edge 29, and it connects two flat perpendicular surfaces 31, 32 constituting the seat of the first rocker 25. This arrangement provides a pivoting support for the second rocker upon the first, thus allowing them to move angularly in relation to each other. The front of second rocker 28 has a ramp 33 consisting of an inclined plane designed to cooperate with cross member 22.

One end of a spring 34, located in a hole in the binding, bears against the end of an adjusting plug 35 screwed into the binding, while the other end bears against the flat rear surface 36 of the second rocker, the plug being used to adjust the tension of spring 34.

FIGS. 5*a* to 5*c* show a variant of the pivot and of the first rocker, from the embodiment illustrated in FIGS. 1 to 5.

In this variant, pivot 4A is recessed, as before, over a portion of its height, but instead of having a flat, it has curved surfaces 230, 240 in horizontal section, the curved surfaces being joined together by a rounded shoulder 231 presenting a curvature in both the vertical and the horizontal plane, as shown quite clearly in FIG. 5.

First rocker 250 exhibits, opposite shoulder 231, a concave surface 270 terminating at each end in convex shoulders designed to bear against shoulder 231 on pivot 4A.

It will be observed that the convex profiles of shoulders 271 ensure point contact between the rocker and the pivot shoulder, as may be seen in particular in FIGS. 5*b* and 5*c* which are sections along line A—A in FIG. 5*a*, but which represent the binding in the normal position, in the case of FIG. 5*b*, and in the released position, in the case of FIG. 5*c*.

FIGS. 1 and 2 illustrate the locked binding holding boot 8 to the ski. In this position spring 34 keeps second rocker 28 against first rocker 25, cylindrical portion 27 of the latter bearing against flat 23 on the pivot and providing the locking load to secure the foot laterally. Moreover, ramp 33 on the second rocker, by cooperating with cross member 22, restricts the rotation of rocker 18 and of the sole-clamp, and this secures the foot vertically.

In the event of a purely lateral load, the binding operates as follows (it is assumed that the sole-clamp is in the position shown in FIG. 1, i.e. that no load is being applied by cross member 22 to second rocker 28).

This lateral load is indicated in FIG. 2 by arrow F, and it acts upon the jaw, holding the boot laterally. The binding rotates about fixed pivot 4 with rockers 25 and 28. Flat 23′ on the pivot acts as a reaction part, and cylindrical portion 27 of rocker 25 comes to rest upon one of the lateral edges of the flat (see FIG. 5), the result of which is to cause rocker 25 to rotate about its axis 26 (see FIG. 4). Second rocker 28 pivots backwards and compressed spring 34. It will be observed that since the two rockers are constantly supported by surface 32 of the first rocker, the entire force of the spring is transferred to pivot 4. If load F is higher than the preset load at which the spring ensures retention of the boot, the binding will release. Otherwise, the binding will automatically return to its initial position as soon as load F disappears.

However, circumstances may occur in which the sole-clamp is not in the position shown in FIG. 1 when a lateral load occurs, for instance when a certain thickness of snow is located between the sole and the ski, or when a vertical load acts simultaneously upon the binding.

Figure 3:
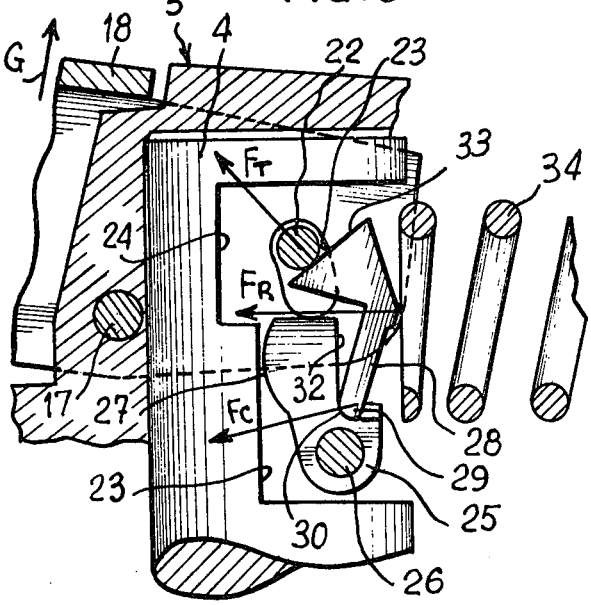
FIG. 3 is a detail illustrating the operation of the compensating mechanism when the sole-clamp is lifted.

In these two cases, the sole of the boot applies to sole-clamp 20 a vertical thrust G which lifts it, for example, into the position shown in FIG. 3, as a result of the rocker rotating about axis 17. Since the sole of the boot is then pressed heavily against the sole-clamp, the device according to the invention prevents any impairment of the lateral release by the friction existing at the level of this contact.

The pivoting movement of rocker 18 thus causes cross member 22 to bear against ramp 33 of second rocker 28, causing the latter to rotate in fillet 30 of the first rocker. Second rocker 28 is thus in sole contact with the first at the level of fillet 30, and force $F_R$, to which the second rocker is subjected, breaks down into two forces $F_T$ and $F_C$, force $F_T$ applied to cross member 22 holding the foot vertically, whereas force $F_C$ applied to the first rocker holds the foot laterally.

It may be seen quite clearly that, in the case of FIG. 3, the distance between axis 26 of the first rocker and the point of application of force $F_C$ is much less than that shown in FIG. 1, in which force $F_C$ is applied almost at the upper end of rocker 25. This variation in the arm of the lever applying the force of the spring to the first rocker makes it possible to reduce the value of the lateral unlocking load, which thus compensates for the "pinching" of the sole of the boot against the sole-clamp.

It will be noted that after the lateral load has caused the binding to pivot through a certain angle, first rocker 25 again contacts the second rocker, and spring 34 applies its thrust to the two rockers, as in the case of a purely lateral release. Continued rotation of the rockers causes cross member 22 and the second rocker to separate, and the pinching action on the sole of the boot ceases, since there is no longer anything to prevent the sole-clamp from lifting.

In the embodiment illustrated in FIGS. 6 to 10, the general configuration of the binding is similar to that of the preceding example. The following description therefore deals only with elements which differ from one example to the other.

As may be seen in FIG. 6, binding 40, comprising at the front a jaw similar to that described in connection with FIGS. 1 and 2, is mounted upon vertical pivot 42 and is retained in vertical translation by a rod 43 engaging in a groove 44 in the pivot, the rod also serving as a pivot axis for rocker 45 which carries sole-clamp 46.

As in the preceding example, the pivot is recessed and has a flat 47 extended by an upper recess 48. A horizontal axis 49 integral with the binding extends into the cavity in the pivot. Mounted on this axis are:

on the one hand, a first central rocker 50 comprising, opposite flat 47, a rounded profile 51 and, at the other end, a lug 52 carrying one end of a spring 53, the other end of which bears against an adjusting plug 54 screwed into a bore in the binding;

and, on the other hand, a second rocker 55 consisting of two lateral arms located on each side of the first rocker, and of a cross member 56 connecting the arms at the ends thereof facing their articulation on axis 49.

It will be observed that the part of first rocker 50 adjacent flat 51 has arms 57 designed to support the arms of second rocker 55 (see position in FIG. 6). A second spring 58, concentric with spring 53, runs between adjusting plug 54 and the arms of second rocker 55, tending to apply the latter to arms 57 of the first rocker. It will also be observed that cross member 56 of the second rocker is designed to cooperate with a cam profile 59 provided on the rear end of rocker 45 carrying the sole-clamp.

It will be assumed initially that the binding is in the locked condition, in the position shown in FIG. 6, i.e. that no load is being applied either to the sole-clamp or to the jaw. In this case, spring 53 keeps central rocker 50 in contact with flat 51 on the pivot with a force $F_{r1}$. Spring 58, on the other hand, causes second rocker 55 to bear against arms 57 of the first rocker with a force $F_{r2}$. Thus the total load applied by the first rocker to the flat on the pivot is equal to the sum of $F_{r1} + F_{r2}$ of the two springs. This load ensures that the foot is held laterally.

Vertical retention of the foot is assured by rocker 55, cross member 56 of which opposes the rotation of the rocker 45.

If a purely lateral stress is applied to the boot, with the sole-clamp remaining in the position shown in FIG. 1, the binding rotates about the pivot and the rockers are returned together by pivoting in a clockwise direction about their common axis 49 (see FIGS. 9 and 10). The rockers remain in contact and simultaneously compress springs 53 and 58 which determine the value of the release load.

If, in the event of a lateral load, sole-clamp rocker 45 is lifted by a thrust of the sole acting upon the sole-clamp (by reason of a wedge of snow under the boot, or a vertical load), the device assumes the position shown in FIG. 8. Thus when rocker 45 pivots in the direction of arrow G, rear cam 59 thereof pushes back cross member 56 of the second rocker which pivots clockwise against the action of spring 58 associated therewith. Second rocker 55 is no longer in contact with the first rocker, and the latter is now applied to flat 51 on the pivot only by the action of spring 53. Thus the load required for a lateral release is then no more than $F_{r1}$.

Thus, although the "pinching" effect of the boot against the sole-clamp tends to oppose the release, the value of the lateral release will always be less than with a conventional binding, since the load applied by the resilient system opposing the release is reduced in similar proportions.

As in the case of the preceding example of embodiment, it will be observed that after the lateral load has caused the binding to pivot through a certain angle, first rocker 50 will regain contact with the second, and the two rockers will continue to pivot together. Since the pinching load applied to the sole disappears as a result of the movement of cross member 56 and cam 59 away from the rocker 45 (which becomes free), the conditions are now the same as those existing at the time of a purely lateral load (see FIG. 9).

In the embodiment illustrated in FIGS. 11 to 14, the general structure of the binding is similar to that in FIG. 1, the pivot 4, the binding 5 with its jaw 9, and rocker 18 pivoting on axis 17 and equipped with a sole-clamp 20, all being identical with those in FIG. 1 and arranged in the same way.

However, cross member 22 integral with the rocker is replaced by a "floating" cross member 62 which is mounted free in windows 63 in the sides of the rocker, the said cross member being located transversely to prevent it from coming out of the binding. The binding obviously has lateral openings allowing the said cross member to pass and to move freely.

Furthermore, the pivot is recessed and exhibits a flat 64 extending over the entire height of the recess. Located in this recess is a single rocker 65, the lower end of which is hinged on an axis 66 integral with the binding. The front surface of the rocker, in the form of a part-cylinder 67 with a horizontal axis, is kept in contact with flat 64 on the pivot by means of a spring 68, one end of which bears against an adjusting plug 69 engage in a threaded hole in the binding, while the other end bears against rear edge 71 of the rocker which is the intersection of two divergent inclined planes. Finally, the upper end of the rocker has a ramp 72 consisting of an inclined plane and designed to cooperate with the cross member 62.

This type of binding operates as follows.

First of all it will be assumed that FIG. 11 represents the binding in the normal locked position holding a booyt 8 to the ski, with no vertical load being applied to the sole-clamp.

In this case, spring 68 bears against edge 71 of the rear surface of the rocker, pressing the latter against the flat, and securing the foot laterally. Ramp 72 of the rocker pushes floating cross member 62, on the one hand, towards upper edge 73 of the rocker window and, on the other hand, against flat 64 on the pivot, the cross member thus securing the foot vertically.

If a purely lateral load is applied to the binding in FIG. 11, binding 5 rotates about pivot 4 (see FIGS. 13 and 14), and rocker 65 is caused to pivot about its axis 66 by the rear edge of the flat. This movement of the rocker compresses spring 68, the end of which cooperates with edge 71.

In this position, floating cross member 62 moves away from edge 73 of the rocker window, remaining in contact with the flat and the ramp on the rocker.

If the sole-clamp has been lifted (see FIG. 12) because of the presence of a wedge of snow under the boot, or as a result of the application of a vertical load, rotation of rocker 18 about its axis 17 results in floating cross member 62 being lowered by edge 73 of the rocker window. The cross member then wedges itself between flat 64 and ramp 72 of the rocker, the latter being pushed back against the action of spring 68 and out of contact with flat 64. Thus the whole of force $F_R$ of spring 68 holding the foot vertically and laterally is transmitted by the cross member. Vertical retention is assured by force $F_b$ applied by the cross member of the rocker, whereas lateral retention is assured by force $F_r$ applied by the cross member to the flat.

The lateral retention force due to the spring has been reduced by the fact that the lever arm, i.e. the distance between axis 66 of the rocker and the point of application P of cross member 62 to the flat, is much greater than that shown in FIG. 11 (the distance between axis 66 and the point of application Q of the rocker to the flat). This reduction of the retention force compensates for the "pinching" effect of the sole against the sole-clamp.

What is claimed is:

1. A safety binding for skis which releases at least laterally and comprises:

a vertical pivot integral with a base secured to the ski;

a binding rotating upon the pivot and carrying means for retaining the boot;

a system for locking said retaining means, said system being mounted in the binding and ensuring that the boot is maintained in a specific position upon the ski, said locking system comprising at least one resilient element and opposing a vertical retention force and a lateral retention force, respectively, to the vertical lift and lateral displacement of the boot, said resilient element being preset to allow the boot to be released when subjected to predetermined stresses in the plane of the ski;

and a compensating mechanism acting upon said locking system, in order to cause the lateral retention force applied to the boot to vary inversely to the vertical retention force, said compensating mechanism including:

a first part mounted to pivot about an axis at right angles to the longitudinal axis of the ski and located between the kinematic chain consisting of the resilient element and a reaction part which is fixed in relation to the ski;

and a second part mounted in the binding so as to be mobile in relation to the first part, and cooperating, through a system of ramps, with the boot-retaining means opposing the lifting of said boot.

2. A binding according to claim 1, the transverse axis upon which is mounted said first part is accommodated in the binding.

3. A binding according to claim 1, wherein said second part is mounted to pivot in relation to said first part.

4. A binding according to claim 1, wherein the stationary reaction part is integral with the fixed vertical pivot about which the binding rotates.

5. A binding according to claim 4, wherein said reaction part consists of a vertical flat arranged upon the fixed pivot.

6. A binding according to claim 4, wherein said reaction part consists of a curved profile arranged upon the fixed pivot.

7. A binding according to claim 6, wherein the first part of the compensating mechanism consists of a rocker pivoting about a horizontal axis in the binding and applied to the stationary reaction part by the resilient element of the locking system, in such a manner as to oppose the rotation of the binding;

the second part of the compensating mechanism consists of a second rocker mounted to pivot upon the first rocker and caused, by the resilient element of the locking system, to besar against a cross member mounted in the sole-clamp and transferring to said second rocker the vertical forces applied to said sole-clamp.

8. A binding according to claim 7, wherein the second rocker is mounted to pivot on a seat in the first rocker, so that it may execute a rotary motion in relation thereto.

9. A binding according to claim 8, wherein the resilient system consists of a single spring, one end of which bears against the binding and the other end against the second rocker, the thrust of said spring being transferred to the first rocker through an area of contact between the rockers, the distance of which from the hinge axis of said first rocker varying as a function of the relative angular position of the rockers.

10. A binding according to claim 9, wherein the second rocker is provided with a ramp in its area of contact with the cross member mounted in the sole-clamp.

11. A binding according to claim 6, wherein the compensating mechanism consists of:

a first rocker pivoting about a horizontal axis in the binding and caused to bear against the reaction part by the resilient locking system, in such a manner as to oppose the rotation of the binding about the pivot;

and by a second rocker, also pivoting about a horizontal axis in the binding, the free end of the said rocker being designed to cooperate, under the action of the locking system, with the rear part of the sole-clamp which is in the form of a cam.

12. A binding according to claim 11, wherein the two rockers are mounted upon one and the same pivot axis.

13. A binding according to claim 12, wherein the resilient locking system consists of two springs bearing respectively, on the one hand on the binding and, on the other hand on the free end of one of the rockers.

14. A binding according to claim 13, wherein the first rocker has a support surface acting as a stop for the second rocker, in such a manner that when said rockers are bearing against each other, the load applied by the spring associated with said second rocker is transferred completely to the first rocker.

15. A binding according to claim 6, wherein the compensating mechanism consists of:

a single rocker pivoting about a horizontal axis in the binding and urged towards the flat on the pivot by the resilient locking system bearing, on the one hand on said binding and, on the other hand on said rocker;

and by a part mounted in a housing in the sole-clamp and adapted to move in relation thereto, said part being in constant contact, on the one hand, with a ramp on the free end of the rocker and, on the other hand, with the flat on the pivot, and being designed to transfer the loads between the sole-clamp, the rocker, and the flat on the pivot.

16. A binding according to claim 15, wherein the part mounted in the housing in the sole-clamp is a cylindrical cross member, the ramp on the rocker being a surface inclined in relation to the flat on the pivot.

* * * * *